United States Patent [19]

Mannio

[11] Patent Number: 4,907,529

[45] Date of Patent: Mar. 13, 1990

[54] APPARATUS FOR CONTROLLING THE TILT ANGLE OF A DOCTOR BLADE

[75] Inventor: Aaron Mannio, Järvenpää , Finland

[73] Assignee: Valnet Paper Machinery Inc., Helsinki, Finland

[21] Appl. No.: 241,199

[22] Filed: Sep. 7, 1988

[30] Foreign Application Priority Data

Sep. 7, 1987 [FI] Finland ..... 873869

[51] Int. Cl.[4] ..... B05C 11/04

[52] U.S. Cl. ..... 118/126; 118/123; 427/356

[58] Field of Search ..... 118/708, 107, 240, 126, 118/413, 123; 427/356

[56] References Cited

U.S. PATENT DOCUMENTS

| | | | |
|---|---|---|---|
| 3,113,890 | 12/1963 | Johnson et al. | 118/126 |
| 3,128,207 | 4/1964 | Schmitt | 118/126 |
| 3,245,378 | 4/1966 | Caple et al. | 118/126 |
| 3,282,244 | 11/1966 | Hill et al. | 118/126 |
| 3,335,701 | 8/1967 | Verkinderen et al. | 118/126 |
| 3,363,603 | 1/1968 | Hill | 118/126 |
| 3,722,465 | 3/1973 | Krautzberger | 118/413 |
| 4,220,113 | 9/1980 | Wohlfeil | 118/126 |
| 4,375,202 | 3/1983 | Miller | 118/126 |
| 4,637,338 | 1/1987 | Wöhrle | 118/126 |

*Primary Examiner*—James C. Housel

*Attorney, Agent, or Firm*—Birch, Stewart, Kolasch & Birch

[57] ABSTRACT

An apparatus for controlling the tilt angle of a doctor blade comprising two support blocks for a doctor blade supporting beam, a first actuator by which the supports are movable about their bearing points, a blade supporting beam pivotally mounted between upper parts of the support blocks having a doctor blade attached to the beam, and a second actuator by means of which the blade supporting beam is movable about its pivoting point in order to control the tilt angle and loading of the blade. In accordance with the invention, the first actuator is arranged to rest against a guiding surface of a guiding cam permanently arranged to the pivoting point of the blade supporting beam. The arrangement in accordance with the invention provides a simple and reliable method for blade angle control.

4 Claims, 3 Drawing Sheets

APPARATUS FOR CONTROLLING THE TILT ANGLE OF A DOCTOR BLADE

BACKGROUND AND SUMMARY OF THE INVENTION

The present invention relates to an apparatus for controlling the tilt angle of a doctor blade.

In doctor blade applicators, the amount of coating mix applied to the web is controlled by adjusting the loading of the blade. However, changes in the degree of blade loading also causes a change in the blade's tilt angle, which complicates blade control.

In prior art doctoring units, the blade position has been manually adjusted as required. Compensation systems for blade tilt angle are also known. Finland patent application No. 844035 discloses an apparatus in which two synchronously operated jacks are used to set the degree of blade loading. Finland patent application No. 793164 discloses an apparatus in which loading control is effected by adjusting the shape of the blade while the blade supporting beam is stationary. In this case, the blade supporting beam incorporates a complicated control system for the adjustment of blade stiffness. In a system described in Finland patent application No. 2203/74, loading control is achieved by rotating the blade frame about a shaft, thus causing a deformation of the blade shape and simultaneously altering the reaction force of the blade, while maintaining a constant blade tilt angle.

Manual blade control by methods of conventional technology is slow and incapable of complying with all loading conditions, which results in undesired deviations in the amount of coating mix applied. Compensation systems for doctor blade tilt angle deviations known in the art are complicated in structure, high in cost, and prone to malfunction.

The aim of the present invention is to overcome the disadvantages associated with the aforedescribed prior art technology and achieve a totally new kind of apparatus for controlling the tilt angle of a doctor blade.

The present invention is based on a structure, where a rotatable support beam is supported by a guiding cam against a blade load adjusting device so that the rotation of the beam moves the beam closer to the web, thus increasing the blade loading, while the angle included by the blade tip and a tangent drawn to the contacting point of the tip is maintained constant or controlled in a desired manner.

The blade tilt angle controlling apparatus achieves, by means of an apparent adjustment of the tilt angle, a change in the blade loading while the actual tip angle remains constant, thus simplifying the adjustment of the coating mix application. Thus, the invention provides outstanding benefits.

BRIEF DESCRIPTION OF THE DRAWINGS

The present invention is next discussed in detail with the help of exemplifying embodiments illustrated in the attached drawings, wherein.

DETAILED DESCRIPTION OF THE INVENTION

Figure 1:
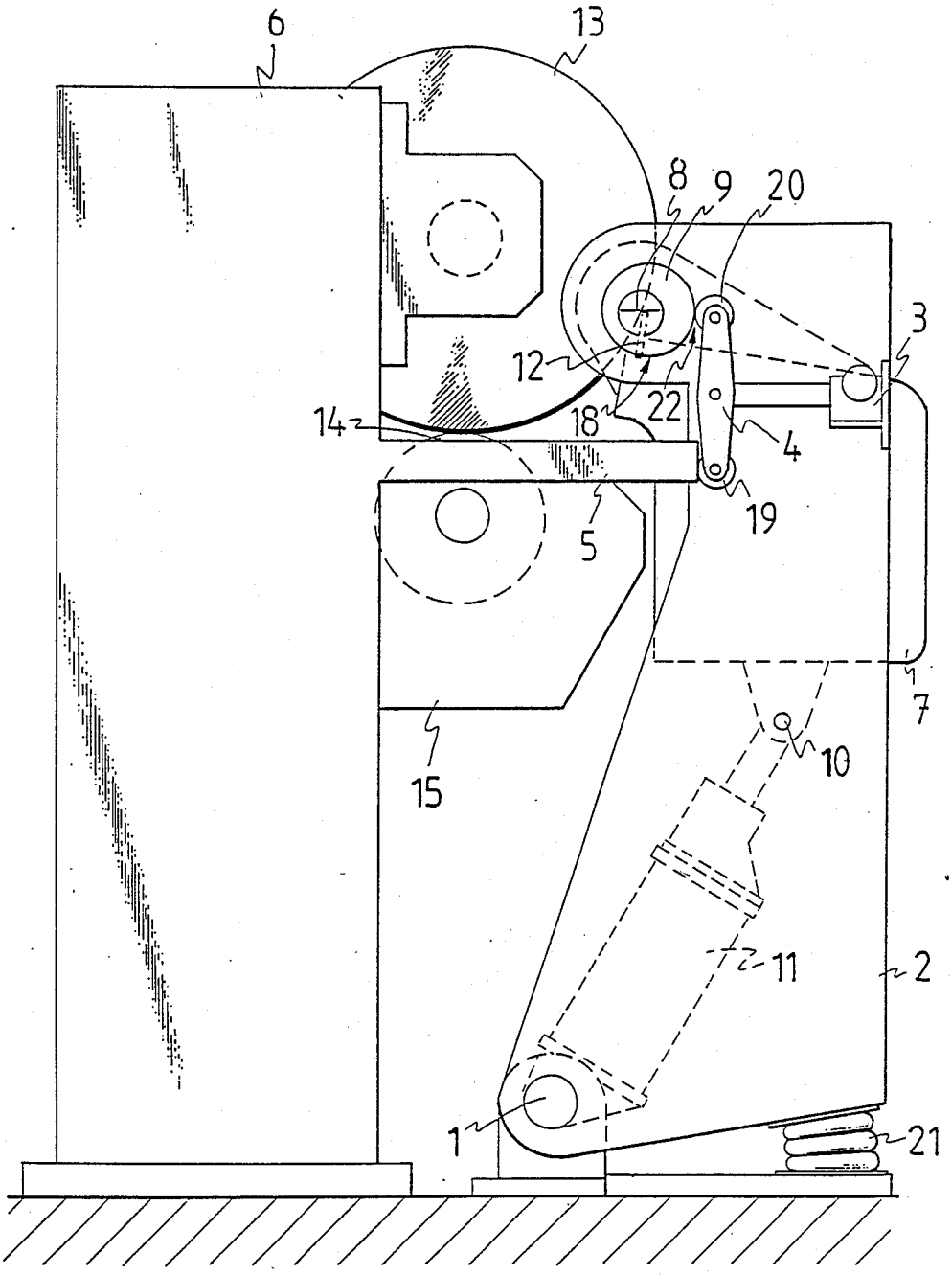
FIG. 1 is a partially longitudinally sectioned side view of a coating mix applicator utilizing a tilt angle control apparatus in accordance with the present invention.

According to FIG. 1, the frame of the doctor blade unit in the coating mix applicator is formed by lever-like support blocks 2 of a beam 7, pivotally mounted on a base at both sides of the applicator by bearing points 1. The support blocks 2 are elevated into their operating positions by means of lift actuators 21 mounted to the base. The beam 7, which supports the doctor blade 12, is located between the support blocks 2 and is pivotally mounted to their upper parts close to a backing roll 13 at a bearing point 8. Correspondingly, the backing roll 13 is pivotally mounted to the upper part of an applicator's frame 6. Under the backing roll 13, in conjunction with a coating mix trough 15 is attached an applicator roll 14. The support blocks 2 of the blade beam are movable about a bearing point 1 by means of a first screw jack 3 adapted to the upper part of the support block 2. Pivotally mounted to an end of the screw jack 3 is a rocker lever 4, which rests via a roller 19 against a support column 5 of the applicator's frame 6. Correspondingly, the upper end of the rocker lever 4 rests via a roller 20 at a contact point 22 against a guiding surface 18 of a circular guiding cam 9 which is permanently and eccentrically adapted to the bearing point 8 of the blade beam 7. The bearing point 8 of the blade beam 7 is located close to the tip of the doctor blade 12. Another screw jack 11, which is pivotally mounted at its lower end to a bearing point 1 of the support block 2 of the blade beam 7, is connected to the lower part of the blade beam 7 at bearing point 10. With the help of the second screw jack 11, the blade beam 7 is rotatable about its bearing point 8 so that a counterclockwise rotation of the blade beam 7 (for the case illustrated in the figure) tends to increase the blade's tilt angle, but in contrast to this, the simultaneous counterclockwise rotation of the guiding cam 9, which rests against the upper end of the rocker lever 4, causes a subsequential reduction of the distance between the contact point 22 of the guiding surface 18 with the roller 20 at the upper end of the rocker lever 4 and the bearing point 8, the blade beam 7, and correspondingly, also the blade 12 is shifted closer to the backing roller 13, thus maintaining a constant tilt angle of the blade.

In the embodiment illustrated in FIG. 1, a circularly shaped guiding surface 18 of the cam 9 has a diameter of 250 mm. The guiding cam 9 is eccentrically displaced by approx. 20 mm in relation to the bearing point 8. The amount of eccentricity as well as the diameter of the cam 9 may be varied to comply with the length of the doctor blade 12 and the supporting method applied. In addition to a circular shape, other ellipsoidal shapes are also conceivable for the guiding surface.

Figure 2:
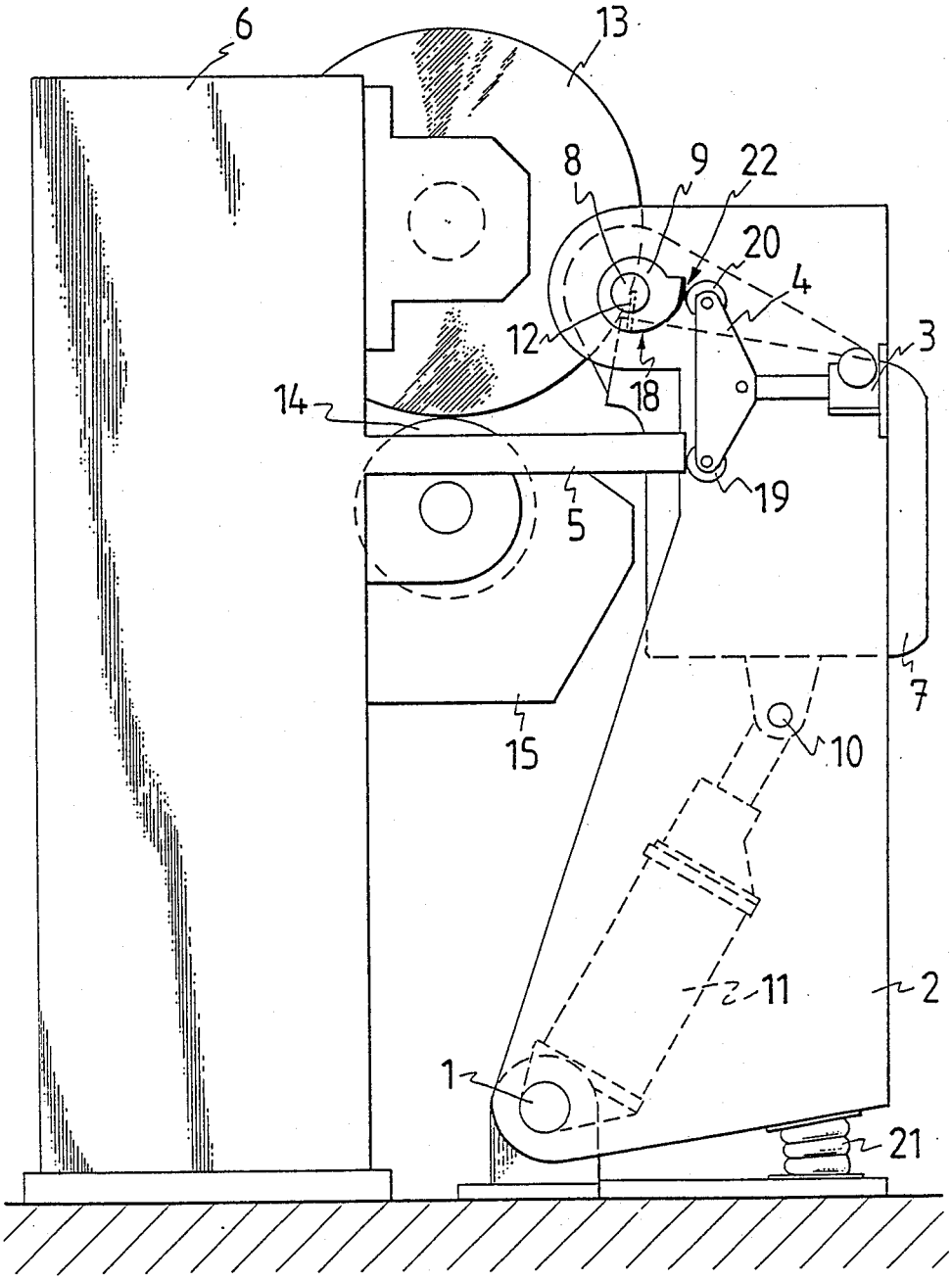
FIG. 2 is a partially longitudinally sectioned side view of a coating mix applicator utilizing another tilt angle control apparatus in accordance with the present invention.

According to FIG. 2, a spiralling guiding surface is further possible.

Figure 3:
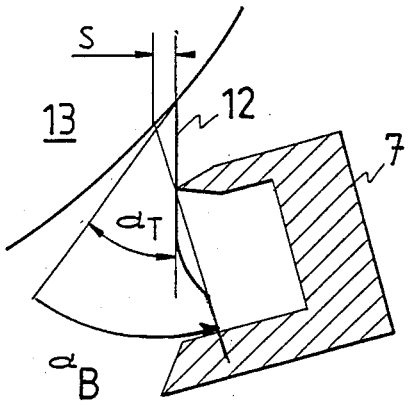
FIG. 3 is a partially longitudinally sectioned side view showing the operation of the doctor blade unit of the applicators illustrated in FIGS. 1 and 2.
Figure 4:
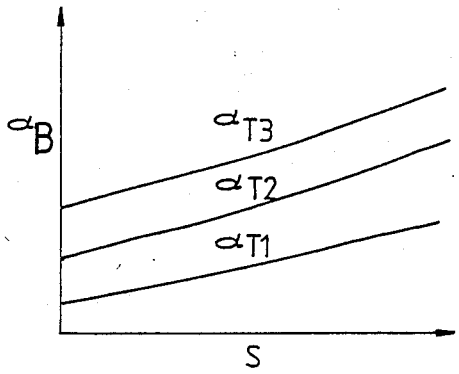
FIG. 4 is a graph of the dependence of the doctor blade tip angle on the rotation and loading of the blade beam.

According to FIGS. 3 and 4, each steplessly adjustable setting of the first lift actuator 3 corresponds to a certain rotation angle $\alpha_B$ of the beam 7 about the bearing point 8, at which angle the contact between the tip of the doctor blade 12 and the backing roll 13 (with a loading $s>=0$) is established. The value of the blade tilt angle $\alpha_T$ is determined by the contact of the tip of the blade 12 with the surface of the roll 13. After a contact is established (with a loading $s>=0$), an increase in the rotation angle of the beam 7 about the point 8 results in a smoothly increasing value of the loading s while the value of the tip contact angle $\alpha_T$ stays constant. The control for the degree of loading during a run is effected by rotating the beam 7 about its bearing point 8 wih the help of the second actuator 11. During a run, the first actuator 3 will not be used. In practice, loading s is defined as distance of the bearing point 8 of the blade beam 7 to the applicator's frame 6 so that the zero distance is defined as the position where the blade 12 is not loaded and the tip of the blade 12 just makes contact with the backing roll 13.

A feasible embodiment is further possible by mounting the first screw jack 3 to the applicator unit's frame 6, in which case the use of the rocker lever assembly 4 is no longer needed.

Furthermore, the operation of the cam 9 may be implemented by means of a programmable logic controller attached to the irst actuator 3, thus making the control variable of the actuator to be determined by a mathematical function related to the position of the second actuator 11. The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for controlling the tilt angle of a doctor blade relative to a backing roll in a coating mix applicator, said apparatus comprises a support, blade supporting beam, a doctor blade supported by the blade supporting beam, said blade supporting beam being pivotally mounted to the support about a bearing point which is located near the tip of the doctor blade, a guiding cam fixed at the bearing point to the beam, a first actuator fixed to the support, said first actuator resting against a guiding surface of said guiding cam, a second actuator operatively attached between the blade supporting beam and the support, said cam being fixed to said blade supporting beam at a point about which the beam is rotated by said second actuator, whereby the distance between the contact point of the first actuator with the cam and the bearing point changes as a function of the rotation of the blade supporting beam, so that the rotation of the blade supporting beam about the bearing point by the second actuator controls said distance between the contact point and the bearing point, as determined by the shape of the guiding cam.

2. The tilt angle controlling apparatus in accordance with claim 1, wherein the guiding surface of the guiding cam has a shape that gives, by counterclockwise rotation of the doctor blade supporting beam, a reduction of said distance between the contact point and the bearing point.

3. The tilt angle controlling apparatus in accordance with claim 1 wherein the first actuator is positioned at an upper part of the support and wherein the first actuator is a rocker lever provided with roller which engage the guiding cam, said cam being constructed as a circular plate permanently mounted at the bearing point.

4. The tilt angle controlling apparatus in accordance with claim 1 wherein the guiding surface of the guiding cam has a spiralling configuration.

* * * * *